United States Patent [19]

Smith et al.

[11] 3,982,467

[45] Sept. 28, 1976

[54] LAUNCH CARTRIDGE ARRANGEMENT

[76] Inventors: Matthew S. Smith, 4400 Sarah, Apt. 29, Burbank, Calif. 91505; Ernest A. Filippi, 5859 E. Ida Place, Greenwood Village, Englewood, Colo. 80110

[22] Filed: Mar. 27, 1975

[21] Appl. No.: 562,785

Related U.S. Application Data

[63] Continuation-in-part of Ser. No. 364,658, May 29, 1973, Pat. No. 3,886,841.

[52] U.S. Cl. ..... 89/1.818; 42/1 F; 89/1 F; 89/1.819; 102/49.7

[51] Int. Cl.[2] ..... F41F 3/04

[58] Field of Search ..... 89/1.816, 1.818, 1.819, 89/1.8, 1 F; 42/1 F; 102/65.2, 49.7, 49.1

[56] References Cited

UNITED STATES PATENTS

| | | | |
|---|---|---|---|
| 2,944,486 | 7/1960 | Jasse | 102/49.1 |
| 3,119,303 | 1/1964 | Jasse | 102/49.7 X |
| 3,134,330 | 5/1964 | Batou | 89/1 F X |
| 3,166,979 | 1/1965 | Draim | 102/49.7 X |
| 3,421,410 | 1/1969 | Kayaian | 89/1.818 X |
| 3,750,979 | 8/1973 | Nelms et al. | 102/49.7 X |

*Primary Examiner*—David H. Brown
*Attorney, Agent, or Firm*—Don B. Finkelstein

[57] ABSTRACT

An improved launch cartridge means for launching a rocket powered round from a spike type launcher wherein the launch cartridge is provided with a probe means extending through the nozzle of the rocket powered round during a first portion of the launch phase thereof to reduce the pressure of the launch gases on the rocket propellant grain of the rocket powered round. The probe means is detachably coupled to the launch cartridge by selectively removable coupling means. For the condition where a pure ballistic trajectory of the rocket powered round is desired, that is, without ignition of the rocket propellant grain in the round, the coupling means is removed and the probe portion of the launch cartridge is driven into gas sealing engagement with the nozzle passage way of the rocket powered round to prevent the launch gases from igniting the rocket propellant grain. If rocket powered flight is desired the coupling means is left installed and the launch gases both launch the round and ignite the rocket propellant grain. The reaction of the launch cartridge to the launch forces exerted by the launch gases positions the launch cartridge adjacent the end of the spike launcher when the rocket propellant round has been launched.

13 Claims, 6 Drawing Figures

LAUNCH CARTRIDGE ARRANGEMENT

REFERENCE TO RELATED APPLICATIONS

This invention is a continuation-in-part of copending patent application Ser. No. 364,658 filed on May 29, 1973 now U.S. Pat. No. 3,886,841, issued June 31, 1975 for IMPROVED ROCKET BOOSTED ROUND, and is related to copending patent application Ser. No. 307,444 filed on Nov. 17, 1972 entitled WEAPON ARRANGEMENT, and to copending patent application Ser. No. 561,474 filed Mar. 24, 1975 entitled IMPROVED LAUNCHER ARRANGEMENT FOR ROCKET POWERED ROUND. The teachings and technology of each of these copending patent applications is incorporated herein.

BACKGROUND OF THE INVENTION

1. Field of the Invention

This invention relates to the rocket launching art and more particularly to an improved launch cartridge for launching a rocket powered round from a spike type launcher.

2. Description of the Prior Art

In copending patent applications Ser. No. 364,658 there is described a rocket powered round launched from a spike launcher. As disclosed therein the spike type launcher has a spike that is inserted into the tailpipe of a rocket powered round. A launch cartridge is positioned between the end of the spike and the rocket powered round. The launch cartridge is spaced from the rocket powered round to provide an initial launch volume between the launch cartridge and the rocket powered round in order to control the pressure of the launch gases exerted on the round for launching thereof. That is, as the volume of the initial launch volume is increased, the pressure of the launch gases is decreased and therefore the launch force and launch velocity of the round are decreased. The launch cartridge has a launch charge means which is ignited by the spike launcher and the ignition of the launch charge means generates the hot pressurized launch gases into the initial launch volume.

Additionally, there is disclosed in copending Patent application Ser. No. 364,658 now U.S. Pat. No. 3,886,841 a probe means coupled to the launch cartridge and the probe means extends into the nozzle of the round in order to decrease the nozzle area during the initial launch phase of the round. The decrease in the nozzle area both limits the impingement on the rocket grain of the hot pressurized launch gases and also further decreases the pressure thereof in order to provide a soft light-off of the rocket propellant grain. This achieves two of the desired conditions. The first condition is that the soft light-off prevents rupturing or cracking of the rocket propellant grain, which has been found to occur when comparatively high pressure launch gases are utilized to ignite the grain. The second desired condition is that the rocket propellant grain is not ignited to full thrust until it has safely cleared the launcher thereby protecting the operating personnel from the rocket exhaust. Thus, in the invention of copending patent application Ser. No. 364,658 now U.S. Pat. No. 3,886,841 the launch gases provide both the launch force for launching the round from the spike launcher and igniting the rocket propellant grain. The launch cartridge as described in patent application Ser. No. 364,658 now U.S. Pat No. 3,886,841 is left at the end of the launcher when the rocket powered round is launched therefrom, and covers by its claims the basic structure for the launch cartridge either coupled to the launcher or as a separate item between the end of the spike launcher and the rocket nozzle in the tailpipe of the round.

In copending patent application Ser. No. 561,474 there is defined a detailed structure for providing the coupling of the launch cartridge to the end of the spike launcher and, further, there is described an embodiment thereof in which the probe means is detachable from the remainder of the launch cartridge to provide sealing of the rocket nozzle at the launch thereof in order to prevent ignition of the rocket propellant grain. Prevention of the ignition of the rocket propellant grain thereby provides a pure ballistic trajectory of the round when it is launched from the spike launcher.

The present invention is concerned with the structural modification to a launch cartridge of the type that is insertable into the tailpipe of the rocket powered round as a separate item. As such, it is positionable when the rocket powered round is mounted on the spike launcher between the end of the spike launcher and the rocket powered round and is left at the end of the spike launcher when the round is launched therefrom and in which the probe means is detachably coupled to the launch cartridge to allow either ignition of the rocket propellant grain in the round when it is launched or, alternatively, for sealing the nozzle to prevent ignition of the rocket propellant grain to provide a pure ballistic trajectory of the round when it is launched.

SUMMARY OF THE INVENTION

Accordingly, it is the object of the present invention to provide an improved launch cartridge for launching a rocket powered round from a spike launcher.

It is another object of the present invention to provide an improved launch cartridge of the type insertable in the tailpipe of the rocket propellant round as a separate item.

It is yet another object of the present invention to provide an improved launch cartridge means having a probe means extending into the nozzle of the rocket powered round and in which the probe means is selectively detachable from the launch cartridge.

The above and other objects of the present invention are achieved, in a preferred embodiment thereof, by providing a launch cartridge detachably secured in the tubular passage way of the tailpipe of the rocket propellant round and spaced a predetermined distance from the aft end of the nozzle block of the round to define an initial launch volume therebetween. The launch cartridge may be secured in this position by a predetermined securing force. The launch cartridge has a body member in which a launch charge means is contained. The launch charge means is adapted to deflegrate upon ignition thereof and generate hot pressurized launch gases which are directed to enter the initial launch volume. When the launch gases are present in the launch volume a launch force is exerted between the launch cartridge and the nozzle block of the round. The launch forces are greater than the securing force and thereby detach the launch cartridge from the tailpipe of the round and also provide the launch forces for launching the round from the spike launcher. The launch cartridge means has a probe means that is detachably coupled to the remainder of the launch cartridge and the probe means has a nozzle sealing plug portion thereof as well as a probe portion extending through the nozzle passage way of the nozzle. When the launch cartridge is inserted in the tailpipe of the round the plug portion of the probe means engages the divergent area of the rocket nozzle and the probe portion extends through the nozzle passage way to provide a reduced gas flow passage way therethrough. The probe means also has a reaction area that is exposed to the hot pressurized launch gases. The probe means is detachably coupled by a selectively removable coupling means to the remainder of the launch cartridge.

When it is desired to fire the round and obtain rocket propulsion therefrom during the flight thereof the coupling means is left installed and the probe means is thus coupled to and remains part of the launch cartridge. The round is inserted on a spike launcher which abuts against the aft end of the launch cartridge. The spike launcher fires the launch charge means by, for example, striking a percussion timer which ignites the launch cartridge charge means and deflegration of the launch cartridge charge means generates the hot pressurized launch gases which flow into the initial launch volume between the launch cartridge charge means and the nozzle block of the round. This provides the initial launch force for both launching the round from the spike launcher and detaching the launch cartridge from the tailpipe of the round. As the round is launched the launch cartridge is left adjacent the end of the spike launcher. The probe means reduces the amount and pressure of the launch gases initially flowing into the rocket propellant grain to thereby provide a soft ingition thereof and delay the onset of full thrust of the rocket grain until the round has safely cleared the launcher and the operating personnel. The launch cartridge staying adjacent the end of the spike launcher merely falls therefrom after the round has been launched in a manner similar to an expended cartridge from a conventional rifle or gun. This prevents injury to the operating personnel by eliminating the condition that occurs in certain types of prior art rounds wherein a launch cartridge is forceably ejected at some distance from the launcher by the rocket and in which the ejected launch cartridge can strike operating personnel with injury inflicting or lethal force.

When it is desired to provide a pure ballistic trajectory of the round that is, without igniting the rocket propellant grain, the coupling means is removed to thereby detach the probe means from the remainder of the launch cartridge. The hot pressurized launch gases react upon the reaction surface of the probe means drive to the probe means axially into the nozzle passage way so that the plug portion thereof provides a gas tight sealing of the nozzle and prevents the hot pressurized launch gases from entering the rocket propellant grain. The coupling means is removed before the launch cartridge is inserted in the tailpipe of the round. Thus, the launch cartridge may be packaged and shipped with the round as a separate item and is inserted into the round prior to launching thereof when the decision as to whether to provide rocket propellant grain ignition or pure ballistic flight of the round is made.

Launching of the round in a pure ballistic trajectory is achieved by the same technique described above. That is, the round is inserted on the spike launcher and the end of the spike abuts against the aft end of the launch cartridge. The spike launcher causes the ignition of the launch charge means to generate the hot pressurized launch gases which enter the initial launch volume. The hot pressurized launch gases also impinge against reaction area of the probe means and, since the coupling means has been removed, drive the probe means into nozzle sealing engagement with the nozzle passage way of the rocket powered round to prevent gas flow therethrough. Therefore the hot pressurized launch gases launch the rocket powered round without igniting the rocket propellant grain and the round is thus launched on a pure ballistic trajectory. The launch forces also exert a force greater than the securing force retaining the charge cartridge in the tailpipe thus detaching the launch cartridge from the tailpipe and leaving the launch cartridge at the end of the spike launcher when the round is launched.

In another embodiment of the present invention the nozzle sealing plug portion of the probe means is axially movable with respect to the remainder of the launch cartridge in order to increase the spacing of the launch cartridge from the nozzle of the rocket powered round thereby increasing the initial launch volume. The increase in the initial launch volume lowers the pressure of the launch gases and therefore decreases the launch velocity of the round. The axially moveable nozzle sealing plug portion may be utilized for either rocket powered flight of the round or the pure ballistic launching with the rocket propellant grain not ignited as described above.

In order to increase the launch velocity there is also described an emobdiment in which secondary launch charge means are positioned in the initial launch volume. The secondary launch charge means are ignitable by the hot pressurized launch gases and thereby generate a higher pressure launch gas and provide a greater launch force for increasing the launch velocity.

BRIEF DESCRIPTION OF THE DRAWINGS

The above and other embodiments of the present invention may be more fully understood from the following detailed description taken together with the accompanying drawings wherein similar reference characters refer to similar elements throughout and in which.

DESCRIPTION OF THE PREFERRED EMBODIMENTS

Figure 1:
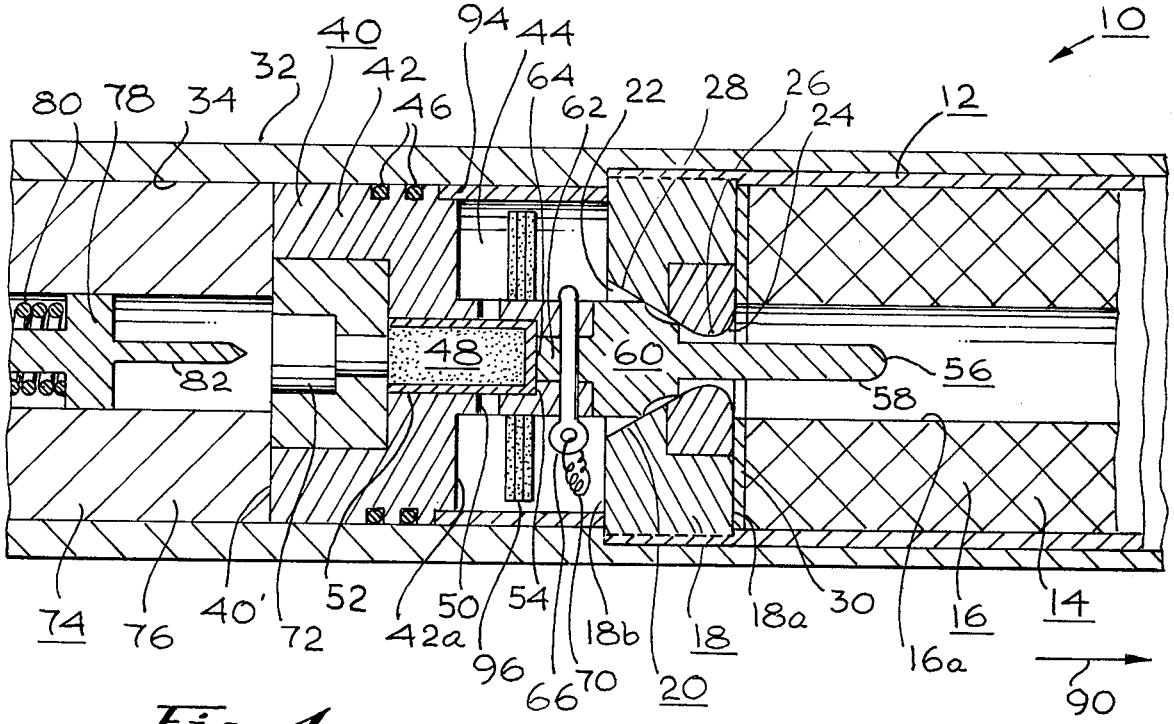
FIG. 1 is a sectional view of one embodiment of the present invention.

Referring now to FIG. 1 there is illustrated a preferred embodiment of the present invention generally designated 10. As shown in the present invention there is a rocket powered round 12 having a rocket motor 14 provided with a rocket propellant grain 16, a nozzle block 18 having walls 20 defining a nozzle passage 22 having a convergent section 24 a throat section 26 and a divergent section 28. The throat section 26 has a predetermined area. The forward end 18*a* of the nozzle block 18 is adjacent an inhibitor disc 30 which prevents ignition of the rocket propellant grain 16 on end surfaces thereof. As shown in FIG. 1 the rocket propellant grain 16 is provided with internal walls 16*a* which are the walls upon which initial ignition thereof occurs. Thus the rocket propellant grain 16 is a progressive or radial burning rocket propellant grain. The nozzle passage defined by the walls 20 extend from the forward end 18*a* of the nozzle block 18 to the aft end 18*b* thereof and provide communication into the rocket propellant grain 16. In general, the rocket powered round 12 may be similar to the rocket powered round described in copending patent application Ser. No. 364,658 now U.S. Pat. No. 3,886,841. The round 12 is further provided with a tubular tailpipe 32 having internal walls 34.

A launch cartridge 40 according to the principles of the present invention is provided and may be detachably secured in the tailpipe 32 of the rocket powered round 12. The launch cartridge 40 is provided with a body means 42 in spaced relationship to the aft end 18*b* of the nozzle block 18 of the rocket powered round 12 to define an initial launch volume 44 therebetween. Securing means may be provided for detachably securing the body means 42 in the tailpipe 32 with a predetermined securing force. The securing means may, for example, be a light frictional fit between the body member 42 and the internal walls 34 of the tailpipe 32, a light bonding therebetween, or any other desired type of temporary detachable securing. The securing force is that sufficient to hold the launch cartridge 40 in place during normal handling and utilization of the round 12 after the launch cartridge 40 is inserted therein and prior to launch thereof. If desired, a sealing means such as "O" rings 46 may be provided to provide the securing force between the launch cartridge 40 and the tailpipe 32 as well as providing a gas tight seal between the body means 42 and the internal walls 34 of the tailpipe 32.

A launch charge means 48 is provided in the body means 42. The launch charge means 48 is adapted to drflagrate upon ignition thereof to generate hot pressurized launch gases. First walls 50 in the body means 40 are provided to define a gas passage communicating the launch cartridge charge means 48 and the initial launch volume 44. The launch cartridge charge means 48 is contained within a frangible wall container 52 having an end portion 54 thereof that is adapted to rupture upon ignition of the launch charge means 48. Thus, the container means 52 may, for example, may be a thin metal foil, a thin plastic or the like.

A probe means 56 is detachably coupled to the body means 42 and the probe means 56 has a probe portion 58 that extends through the nozzle passage 22 and through the throat area 26. The probe portion 58 has a predetermined area slightly less than the throut section 26 of the nozzle passage way 22 and thereby reduces the gas flow passage area through the nozzle passage 22 for reasons herein after described in detail. The probe means 56 also has a nozzle sealing plug portion 60 for gas sealing engagement with the divergent portion 28 of the nozzle passage 22 as described below in greater detail. For the condition of the launch cartridge 40 inserted into the tailpipe 32 adjacent the nozzle block 18 of the round 12 as shown in FIG. 1 the nozzle sealing plug portion 60 need not be in gas tight sealing relationship to the walls 20 of the nozzle passage way 22.

The probe means 56 is also provided with a base portion 62 adjacent the body means 42. The probe means 56 also has walls 64 defining a preselected reaction area. In the embodiment shown in FIG. 1 the preselected reaction area is defined by the wall 64 abutting against the end portion 54 of the frangible container means 52 containing the launch charge 48. Therefore, upon ignition of the launch cartridge charge 48 the reaction area 64 is exposed to the hot pressurized launch gases generated by the deflagration of the launch cartridge charge means 48.

A coupling means 66 is provided for selectively detachable coupling of the probe means 56 to the body means 42 with a predetermined retaining force. For the purposes as hereinafter set forth in greater detail the coupling means 66 is removable to thereby allow detachment of the probe means 56 from the body means 42. In the embodiment shown in FIG. 1 the coupling means 66 comprises a pin extending through the body means 42 and the base portion 62 of the probe means 56. For the condition of the coupling means 66 installed as shown in FIG. 1 the probe means 56 is securely coupled by the predetermined retaining force exerted by the coupling means 66 to the body means 42 and is not separated therefrom when the round 12 is launched.

However, when the coupling means 66 is removed for example by pulling on the attachment wire 70 before the launch cartridge 40 is inserted in the tailpipe 32, the probe means 56 is detached from the body means 42 when the launch cartridge means 48 is ignited.

Ignition means 72 which, for example, may be a percussion primer of conventional design, is provided in the launch cartridge 40 to ignite the launch cartridge charge means 48.

When it is desired to launch the round 12, the tailpipe 32 is slidably mounted on a spike launcher 74. The spike launcher 74 may be similar to the spike launcher described in copending patent application Ser. No. 364,658 now U.S. Pat. No. 3,886,841. As such it is provided with a spike portion 76 which engages the internal walls 34 of the tailpipe 32 and abuts against the aft end 40' of the launch cartridge 40. The spike launcher 74 has a firing pin 78 contained therein and biased towards the launch cartridge 40 by a spring means 80. In the embodiment shown in FIG. 1 the firing pin 78 is in the retracted position and maintained therein by a trigger mechanism (not shown) of conventional design which may be activated to release the spring 80 and drive the firing pin 78 forward. When the firing pin 78 moves forward a probe portion 82 thereof engages the percussion primer 72 which in turn ignites the launch cartridge means 78 to generate the hot pressurized launch gases.

For the condition when the rocket propellant grain 16 of the rocket propellant round 17 is to be ignited to provide a powered portion of flight thereof after launch, the coupling means 66 is left installed to retain the probe means 56 on the body means 42. The hot pressurized launch gases from the deflagrating launch cartridge charge means 48 pass through the gas passage way defined by the first walls 50 and into the initial launch volume 44. In the initial launch volume 44 they expand and thereby reduce the pressure and, to some extent the temperature thereof. In the initial launch volume 44 they exert a launch force against the aft end 18*b* of the nozzle block 18 and against the forward end 42*a* of the body means 42. The launch force is greater then the securing force securing the launch cartridge 40 in the tailpipe 32 and therefore as the launch forces react on the aft end 18*a* of the round 12 the launch cartridge 42 is detached from the tailpipe 32 and remains in abutment against the end of the spike portion 76 of the spike launcher 74. As the round 12 commences to move in the direction indicated by the arrow 90 gas flows through the nozzle passage way and into the reduced area between the probe portion 58 and the throat 26 of the nozzle 18. This further reduces the pressure and the temperature of the hot pressurized launch gases and provides a soft ignition on the surfaces 16*a* of the rocket propellant grain 16. Therefore, the rocket propellant grain 16 is not ignited to full thrust during the initial launch volume and does not achieve full thrust until the round 12 has safely traveled from the launcher 74 and the operating personnel thereof in order to prevent the operating personnel from being subjected to the hot rocket gases with the possibility of injury to the personnel. Similarly, the launch cartridge 44 remains adjacent the end of the spike 76 as the round 12 leaves the launcher 74 and, after launching, merely falls under gravity forces to the ground in front of the launcher. Therefore, there are no injuries to the personnel operating the spike launcher 74 which may be occasioned by the launch cartridge being forceably ejected from the round 12 after it has moved free of the launcher 74 as has occurred with several prior art devices of a similar nature.

When it is desired to fire the round 12 in a pure ballistic trajectory the rocket propellant grain 16 is not ignited. In order to prevent ignition of the rocket propellant grain 16 the coupling means 66 is removed before the launch cartridge 40 is inserted into the tailpipe 32 of the round 12. For this condition, when the launch cartridge charge means 48 is ignited the preselected reaction area 64 of the probe means 56 is subjected to the hot pressurized launch gases and, free of the retaining force provided by the pin 66, is driven by the drive force exerted on the reaction area 64 so that the nozzle sealing plug portion 60 is driven into gas tight sealing relationship with the divergent portion 28 of the nozzle 18. This prevents any flow of the hot pressurized launch gases from the initial launch volume 44 into the rocket propellant grain 16 and thereby prevents ignition thereof. The probe means 56 therefore effectively seals the nozzle 18 to prevent ignition of the rocket propellant grain 16 and remains a part of the round 12 during its pure ballistic flight provided by the force exerted by the launch force generated by the hot pressurized launch gases.

In order to insure that the probe means 56 is retained on the body means 42 when it is desired to ignite the rocket propellant grain 16, the drive forces exerted on the reaction area 64 of the probe means 56 are less than the retaining force provided by the coupling means 66 for retaining the probe means 56 coupled to the body means 42 of the launch cartridge 40.

A tubular sleeve means 94 may be coupled to the body means 42 of the launch cartridge 40 around the initial volume 44. For the configuration shown in FIG. 1 the initial launch volume 44 is at the minimum volume. That is, the aft end 18*b* of the nozzle 18 of the round 12 abuts against the sleeve means 94 and the nozzle sealing plug means 60 abuts against the divergent portion 28 of the nozzle passage way 22 in the nozzle 18. Therefore, the axial spacing of the body means 42 of the launch cartridge 40 is at its closest proximity to the round 12 for the configuration shown in FIG. 1. Therefore, the launch forces exerted on the round 12 are at a maximum. However, if it is desired to provide an even greater launch force, secondary launch charge means 96 which may be in the form of annular wafers placed in the initial launch volume 44 may be utilized. The additional or secondary launch charge means 96 are ignitable by the hot pressurized launch gases generated by the deflagration of the launch cartridge charge means 48 and provide additional launch forces to increase the launch velocity of the round 12.

Figure 2:
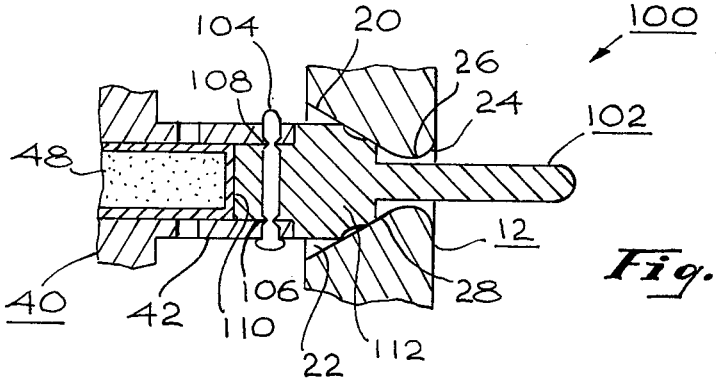
FIG. 2 is a sectional view of another embodiment of the present invention.

In the embodiment of applicant's invention shown in FIG. 2, generally designated 100, there is provided another arrangement for coupling the probe means 102 which, in general, may be similar to the probe means 56 described above, to the body means 42 of a launch cartridge 40. In the embodiment 100 shown in FIG. 2 the coupling means 104 is comprised of a shear pin having two shear points as indicated at 106 and 108. The shear pin 108 couples the probe means 102 to the body means 42 with a predetermined retaining force to retain the probe means 102 on the body means 42 when it is desired to ignite the rocket propellant grain (not shown in FIG. 2) as described above. However, when it is desired to have a pure ballistic flight of the round 12 the probe means 102 may be rotated to shear the shear pin 104 at the two shear points 106 and 108. The amount of shear force necessary to shear the shear pin 108 is carefully selected so that the shear force is greater than the drive force exerted on the reaction area 110 of the probe mean 102 when subjected to the hot pressurized launch gases generated by the deflagration of the launch charge means 48. Therefore, when rocket ignition of the rocket propellant grain is desired the drive forces do not shear the shear pin 104 and the probe 102 remains attached to the body means 42. However, when the probe means 102 has been rotated to shear the shear pin 104 at the shear points 106 and 108 the drive force exerted on the reaction area 110 drives the nozzle sealing portion 112 of the probe means 102 into gas tight sealing relationship with the divergent walls 28 of the nozzle passage way 22. Therefore, for the embodiment shown in FIG. 2 the probe means 102 is rotated to shear the pin 104 before the launch cartridge 40 is inserted into the tailpipe of the round 12.

Figure 3:
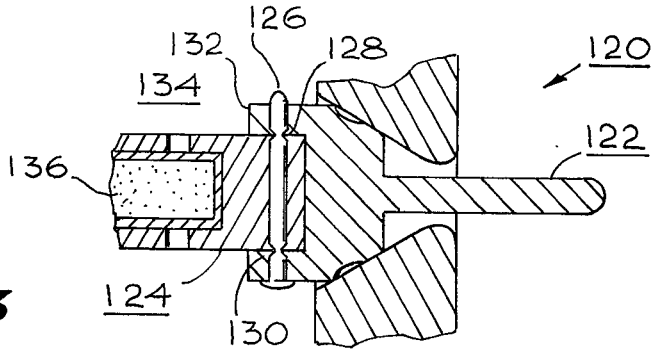
FIG. 3 is a sectional view of another embodiment of the present invention.

In the embodiment generally designated 120 shown in FIG. 3 a probe means 122 is provided that is similar to the probe means 56 described above and is shown coupled to a launch cartridge 124 which may be similar to the launch cartridge 40 described above by a shear pin 126 similar to the shear pin 104 described above and having two shear points 128 and 130. The shear pin 126, as in the embodiments of FIGS. 1 and 2 described above, retains the probe means 122 in a detachable coupling engagement with the launch cartridge 124 by a predetermined retaining force.

In the embodiment 120 shown in FIG. 3 the reaction area 132 of the probe means 122 is in the initial launch volume 134 where it is subjected to the hot pressurized launch gases generated by the deflagration of the launch cartridge charge means 136. The area of the reaction area 132 is carefully selected to that the drive force exerted thereon is less than the retaining force holding the probe means 122 detachably on to the launch cartridge 124. When a shear pin 126 is utilized the drive force, therefore, is less than the shear force necessary to shear the shear pin 126 at the point 128 and 130.

It will be appreciated, of course, that a pin means similar to the pin means 66, that is, without shear points but one that is entirely removed in order to prevent ignition of the rocket propellant grain may be utilized in place of the shear pin 126 in the embodiment shown in FIG. 3.

Figure 4:
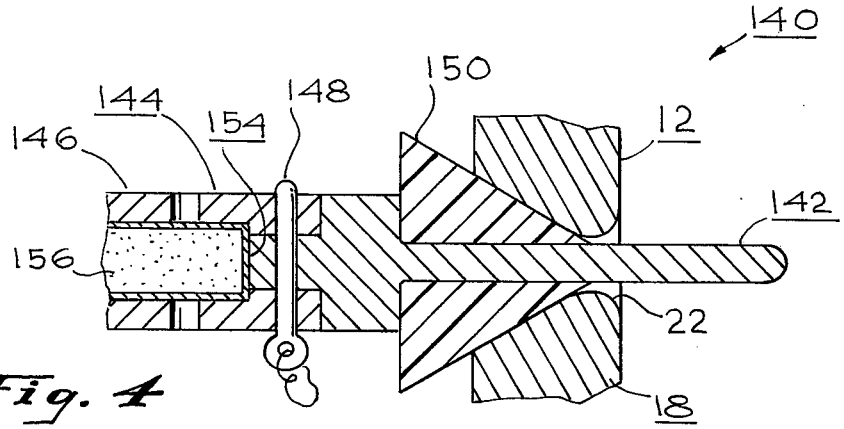
FIG. 4 is a sectional view of another embodiment of the present invention.

In some embodiments of the present invention it may be desirable to provide a resilient member for sealing the nozzle when it is desired to prevent rocket ignition. One such embodiment generally designated 140 is illustrated in FIG. 4 wherein a probe means 142 is detachably coupled by a predetermined retaining force to a body means 144 of a launch cartridge 146 by a removable pin 148 which, for example, may be similar to the pin 66 described above in connection with FIG. 1. Alternatively, of course, a shear pin similar to the shear pin 104 described above in connection with the embodiment shown in FIG. 2 may be utilized instead of the removable pin 148 to achieve the coupling between the probe means 142 and the body means 144.

In the embodiment 140 the nozzle sealing plug portion 150 is mounted on the probe portion 152 and may be fabricated, for example, of a resiliently deformable metal, a hard rubber, plastic, or the like. The resiliently deformable characteristic is such that when the coupling means 148 is removed and the reaction area 154 of the probe means 142 is exposed to the hot pressurized launch gases generated by the deflegration of the launch charge means 156 the drive force exerted thereon drives the nozzle sealing plug means into the nozzle passage way 22 of the nozzle 18 to provide a gas tight seal and prevent ignition of the rocket propellant grain in the round 12.

As noted above the embodiment shown in FIG. 1 illustrates a launch cartridge 40 in the closest axial relationship to the round 12 in order to provide the minimum initial launch volume 44 and therefore the maximum launch force and launch velocity of the round 12. In some embodiments, however, it may be desired to decrease the launch velocity, particularly where a pure ballistic trajectory may be required so that the round 12 strikes at a comparatively close target area. Therefore, in order to increase the initial launch volume 44 and thereby decrease the pressure of the launch gases and therefore decrease the launch force and launch velocity of the round 12 the embodiments of FIGS. 5 and 6 which provide an axial movement of the nozzle sealing plug portion of the probe means with respect to the body means of the launch cartridge may be utilized.

Figure 5:
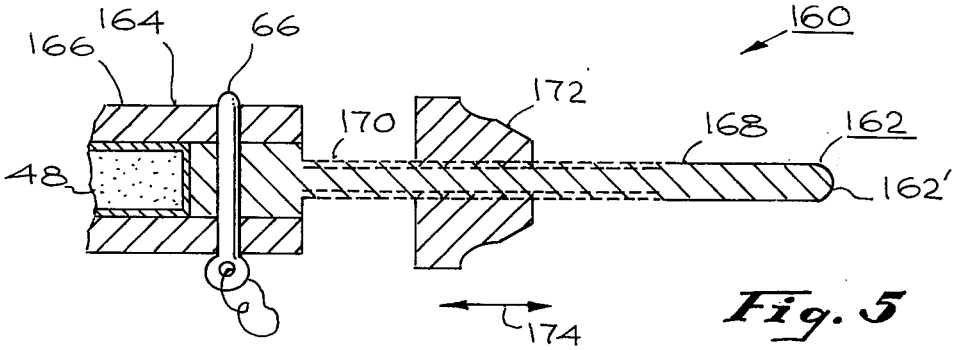
FIG. 5 is a sectional view of another embodiment of the present invention.

As shown in the embodiment 160 of FIG. 5 there is a probe means 162 detachably coupled with a predetermined retaining force to a body means 164 of a launch cartrdige 166. The launch cartridge 166 may be similar to the launch cartridge 40 described above. The detachable coupling is provided by a removable pin 66 which may be the same as the removable pin 66 shown in FIG. 1. However, in the embodiment 160 the probe 168 is provided with a threaded section 170 and the nozzle sealing plug portion 172 threadingly engages the portion 170 of the probe portion 168 for axial mvoement in the direction indicated by the arrow 174. By moving the nozzle sealing plug mean 172 axially outwardly towards the end 162 of the probe means 162 the initial launch volume between the round 12 and the body means 164 is increased thereby decreasing the launch forces when the embodiment 160 is installed as illustrated in FIG. 1. Within the limitations of size imposed by the physical size of the component parts, any desired initial launch volume may be achieved. It will be appreciated of course, that a resiliently deformable nozzle sealing plug 172 similar to the resiliently deformable nozzle sealing plug 150 shown in FIG. 4 may be utilized in the embodiment 160 illustrated in FIG. 5.

Figure 6:
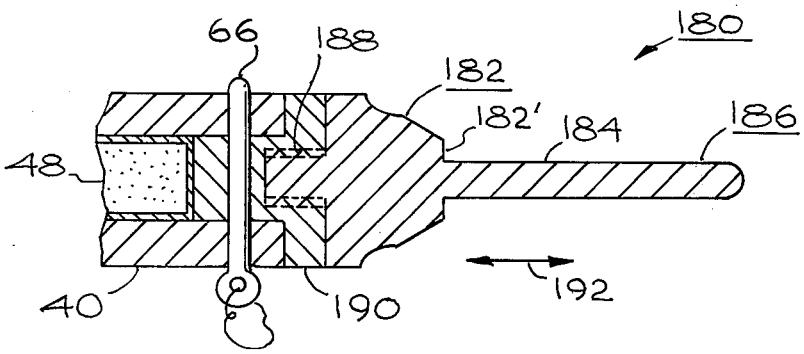
FIG. 6 is a sectional view of another embodiment of the present invention.

In the embodiment of FIG. 6 an embodiment 180 similar to the embodiment shown in FIG. 5 is provided except that the nozzle sealing plug portion 182 is part of the probe portion 184 of the probe means 186 and the threading engagement occurs at 188 with the base portion 190 of the probe means 196 to allow axial movement of the nozzle sealing plug portion 182 in the direction indicated by the double ended arrow 192 to provide an increase in the initial launch volume when utilized in a configuration such as that shown in FIG. 1 described above.

In some combinations of rocket propellent grain and launch cartridge charge means, it may not be necessary to reduce the pressure and/or temperature of the hot pressurized launch gases to which the rocket propellent grain is subjected in order to prevent damage or rupture thereto when the grain is ignited. Accordingly, the probe portion extending through the nozzle to decrease the gas passage area therethrough may not be necessary in such a configuration. However, in providing a launch cartridge according to the principals of the present invention, sealing of the nozzle to prevent rocket motor ignition may still be accomplished. For example, in the embodiment 180 shown in FIG. 6 the probe portion 184 may be removed for example at the forward face 182' of the nozzle sealing plug means 182 by, for example, cutting, snipping, or just breaking off the probe portion 184. The coupling means comprising the removable pin 66 couples the nozzle sealing plug means 182 to the launch cartridge 40. When the pin 66 is removed and the launch cartridge 40 fired, the nozzle sealing plug portion 182 is driven into gas sealing relationship with the walls to the rocket nozzle to prevent ignition of the rocket propellent grain. Further, in such an embodiment as shown in FIG. 6, axial movement of the nozzle sealing plug means 182 may also be accomplished when the probe portion 184 is removed in the manner described above.

When the embodiment 180 in FIG. 6 as described above is utilized without the probe portion 184, delay in full ignition and full thrust of the rocket propellent grain may be achieved, for example, by decreasing the area of the walls of the rocket propellent grain utilized to provide initial ignition thereof, such as the walls **16*a* shown in FIG. 1. This may be achieved by reducing the diameter of the aperture defined by the walls 16*a*.**

From the above it can be seen that there has been provided an improved launch cartridge for launching a rocket powered round wherein the same launch cartridge may be utilized to provide either a pure ballistic trajectory of the round without ignition of the rocket propellent grain or, alternatively, a powered portion of the flight of the round by allowing ignition of the rocket propellant grain. Additionally, the launch cartridge remains adjacent to the end of the spike launcher from which the round is launched and falls under gravity forces to the ground to prevent injury to operating personnel. Additionally, when the rocket propellent grain is ignited, a soft ignition delaying combustion of the rocket propellant grain to full thrust capabilities thereof is delayed until the round has safely cleared the launcher and the operating personnel to prevent the operating personnel from being subjected to the hot rocket exhausts.

Those skilled in the art may find many variations and adaptations of the invention herein and the appended claims are intended to cover all such variations and adaptations falling within the true scope and spirit thereof.

We claim:

1. In an improved launch cartridge for launching a rocket powered round from a spike type launcher wherein the rocket powered round has a tailpipe, a rocket propellant grain, a nozzle block and walls in said nozzle block defining a nozzle passage way therethrough communicating said tailpipe with said rocket propellant grain, and wherein the spike of the spike type launcher is insertable into the tailpipe of the rocket powered round, and the launch cartridge is of the type that is detachably insertable into the tailpipe of the rocket powered round intermediate the forward end of the spike of the spike type launcher and the aft end of the nozzle block of the rocket powered round, the improvement to the launch cartridge comprising, in combination:

a body means in spaced relationship to said nozzle block of said rocket powered round to define an initial launch volume therebetween;

a launch charge means in said body means for generating hot pressurized launch gases for the condition of the ignition thereof;

first walls in said body means defining gas flow passage way for transferring said hot pressurized launch gases from said launch charge means to said initial launch volume;

probe means detachably coupled to said body means and having:

a probe portion extending into said nozzle passage way of said nozzle block of said rocket powered round to decrease the gas passage transfer area therethrough;

a nozzle sealing plug portion for gas sealing engagement with said nozzle passage way of said rocket powered round for the condition of said probe means detached from said body means;

a base portion adjacent said body means; and walls defining a reaction area for exposure to said hot pressurized launch gases;

coupling means for selectively detachable coupling of said probe means to said body means with a predetermined retaining force;

ignition means coupled to said body means for igniting said launch cartridge charge means;

and ignition of said launch cartridge charge means generates said hot pressurized launch gases in said initial launch volume and against said reaction area of said probe means to exert a predetermined drive force on said probe means less than said predetermined retaining force, and said hot pressurized launch gases in said initial launch volume exerting a launch force between said launch cartridge means and said rocket powered round for launching said rocket powered round from said spike launcher and detaching said launch cartridge means from said rocket powered round, and said hot pressurized launch gases igniting said rocket propellant grain for the condition of said coupling means retaining said probe means on said body means, and said driving force for driving said probe means into said nozzle passage way of said rocket powered round for nozzle sealing engagement of said nozzle sealing plug means thereof with said nozzle passage way to prevent ignition of said rocket propellant grain of said rocket powered round for the condition of said coupling means removed, whereby said body means of said launch cartridge is positioned against said spike launcher for the condition of said rocket powered round mounted thereon.

2. The arrangement defined in claim 1 wherein said coupling means further comprises:

pin means extending through said base portion of said probe means and through said body means for said detachable coupling of said probe means to said body means at said predetermined retaining force.

3. The arrangement defined in claim 2 wherein:

said pin means is selectively removable to detach said probe means from said body means.

4. The arrangement defined in claim 2 wherein:

said pin means further comprises:

shear section means for shearing at a predetermined shear force to detach said probe means from said body means, and said predetermined shear force greater than said predetermined drive force, whereby rotating said probe means relative to said body means exerts said shear force on said pin means to shear said pin means.

5. The arrangement defined in claim 2 wherein:

said nozzle sealing plug portion of said probe means engages said nozzle passage way of said rocket powered for the condition of the launch cartridge inserted in said tailpipe of said rocket powered round;

said nozzle sealing plug portion of said probe means is axially movable with respect to said body means for selectively varying said spaced relationship of said body means to said nozzle block to selectively vary said initial launch volume.

6. The arrangement defined in claim 5 wherein:

said nozzle sealing plug portion threadingly engages said probe portion to provide said axial movement of said nozzle sealing plug portion with respect to said body means.

7. The arrangement defined in claim 2 wherein:

said nozzle sealing plug portion is resiliently deformable.

8. The arrangement defined in claim 2 and further comprising:

gas sealing means between said body member and said tailpipe of said rocket powered round to provide a gas tight seal therebetween.

9. The arrangement defined in claim 2 and further comprising:

secondary launch charge means ignitable by said hot pressurized launch gases, and said secondary launch charge means mounted in said initial launch volume for increasing said predetermined launch force.

10. In an improved launch cartridge for launching a rocket powered round from a spike type launcher wherein the rocket powered round has a tailpipe, a rocket propellent grain, a nozzle block and walls in said nozzle block defining a nozzle passageway therethrough communicating said tailpipe with said rocket propellent grain, and wherein the spike of the spike type launcher is insertable into the tailpipe of the rocket powered round, and the launch cartridge is of the type that is detachably insertable into the tailpipe of the rocket powered round intermediate the forward end of the spike of the spike type launcher and the aft end of the nozzle block of the rocket powered round, the improvement to the launch cartridge comprising, in combination:

a probe means having a probe portion extending into said nozzle passageway to decrease the gas flow area therethrough, and a nozzle sealing plug portion;

coupling means for selectively detachble coupling of said probe means to said launch cartridge; and means for driving said plug portion of said probe means into nozzle sealing engagement with said walls in said nozzle block for the condition of said probe means detached from said launch cartridge and when said rocket powered round is launched.

11. In an improved launch cartridge for launching a rocket powered round from a spike type launcher wherein the rocket powered round has a tailpipe, a rocket propellent grain, a nozzle block and walls in said nozzle block defining a nozzle passageway therethrough communicating said tailpipe with said rocket propellent grain, and wherein the spike of the spike type launcher is insertable into the tailpipe of the rocket powered round, and the launch cartridge is of the type that is detachably insertable into the tailpipe of the rocket powered round intermediate the forward end of the spike of the spike type launcher and the aft end of the nozzle block of the rocket powered round, the improvement to the launch cartridge comprising, in combination:

a probe means;

coupling means for selectively detachable coupling of said probe means to said launch cartridge; and means for driving said probe means into nozzle sealing engagement with said walls in said nozzle block for the condition of said probe means detached from said launch cartridge and when said rocket powered round is launched.

12. The arrangement defined in claim 11 wherein:

said probe means is axially movable with respect to said launch cartridge to selectively vary the axial spacing of said launch cartridge from said nozzle block.

13. The arrangement defined in claim 10 wherein:

said probe means is axially movable with respect to said launch cartridge to selectively vary the axial spacing of said launch cartridge from said nozzle block.

* * * * *